United States Patent [19]

Uemura et al.

[11] Patent Number: 4,490,239

[45] Date of Patent: Dec. 25, 1984

[54] PITCH FOR CARBON FIBERS

[75] Inventors: Seiichi Uemura, Tokyo; Shunichi Yamamoto; Takao Hirose, both of Kamakura; Hiroaki Takashima, Kawasaki; Osamu Kato, Yokohama, all of Japan

[73] Assignee: Nippon Oil Company, Limited, Japan

[21] Appl. No.: 477,683

[22] Filed: Mar. 22, 1983

[30] Foreign Application Priority Data

Mar. 29, 1982 [JP] Japan ..... 57-49003

[51] Int. Cl.[3] ..... C10C 3/00; D01F 9/12; D01F 9/20

[52] U.S. Cl. ..... 208/44; 208/22; 423/447.2; 423/447.4

[58] Field of Search ..... 208/22, 44; 423/447.2, 423/447.4, 447.8

[56] References Cited

U.S. PATENT DOCUMENTS

| | | | |
|---|---|---|---|
| 3,317,447 | 5/1967 | Black et al. | 208/44 |
| 3,345,284 | 10/1967 | Ogdin | 208/44 |
| 3,810,857 | 5/1974 | Garrigues et al. | 208/44 |
| 4,024,076 | 5/1977 | Meijuke et al. | 423/447.4 |
| 4,199,434 | 4/1980 | Sze et al. | 208/44 |

FOREIGN PATENT DOCUMENTS

| | | | |
|---|---|---|---|
| 648062 | 9/1962 | Canada | 208/44 |
| 1083063 | 8/1980 | Canada | 208/44 |
| 239264 | 8/1925 | United Kingdom | 208/44 |
| 2068406 | 8/1980 | United Kingdom | 208/44 |

OTHER PUBLICATIONS

La Chimica E. L'Industria, vol. 55, No. 5, May 1973, pp. 425–431, "Heavy Hydrocarbons and Sulfur: Reactions and Reaction Products" Bocca et al.

*Primary Examiner*—Delbert E. Gantz
*Assistant Examiner*—Helane E. Maull
*Attorney, Agent, or Firm*—Scully, Scott, Murphy & Presser

[57] ABSTRACT

A pitch which affords a carbon fiber having a high strength and a high elastic modulus is obtained by treating a pitch containing 5 to 35 weight percent of an optically anisotropic region with sulfur.

5 Claims, No Drawings

PITCH FOR CARBON FIBERS

BACKGROUND OF THE INVENTION

The present invention relates to a modified pitch superior for use in the production of carbon fibers having a high strength and a high elastic modulus (Young's modulus).

At present, carbon fibers are prepared mainly from polyacrylonitrile. But the use of polyacrylonitrile is disadvantageous in that it is expensive, the original fibrous form easily gets out of shape at the time of heat carbonization treatment, and the carbonization yield is poor.

Recently, in view of such drawbacks, there have been reported a number of methods for producing carbon fibers from a less expensive pitch. However, carbon fibers obtained from pitch still involve a problem such that they are inferior in strength as compared with polyacrylonitrile carbon fibers.

It has recently been reported (see U.S. Pat. No. 4,005,183) that a carbon fiber superior in both elastic modulus and strength is obtainable by heat-treating a commercially available petroleum pitch to obtain a pitch containing 40 to 90 wt. % of an optically anisotropic liquid crystal called mesophase, then melt spinning the mesophase-containing pitch, rendering the resultant pitch fiber infusible, followed by carbonization and subsequent graphitization if required.

However, since a pitch containing not less than 40 wt. % of mesophase is extremely high in its softening point and viscosity, its melt spinning requires a high temperature usually not lower than 350° C. As a result, the pitch is apt to undergo a thermal decomposition in the course of melt spinning and produce a light gas, thus making it difficult to attain a uniform spinning.

In case the content of the mesophase is adjusted low with a view to adjusting the softening point and viscosity of the resulting pitch, there occurs separation between optically anisotropic and isotropic regions and the melt characteristic of the pitch is greatly deteriorated. More particularly, even if a pitch having a low mesophase content is subjected to melt spinning, there occurs breakage of thread frequently, and in the worst case the resultant fiber is like a linkage of unmelted particles, and even if such a fiber is treated by a conventional method, there is not obtained a carbon fiber having a high strength and a high elastic modulus.

SUMMARY OF THE INVENTION

It is an object of the present invention to eliminate the above-mentioned drawbacks of the prior art.

It is another object of the present invention to provide a process capable of improving the melt characteristic of a pitch of a low mesophase content having a low softening point and a low viscosity, thereby permitting a uniform spinning, and further capable of producing carbon fibers having a high strength and a high elastic modulus.

The above-mentioned objects of the present invention can be attained by treating a pitch having 5 to 35 wt. % of an optically anisotropic region with sulfur. By using the so-prepared pitch of the present invention, it is made possible to effect a uniform spinning and produce carbon fibers having a high strength and a high elastic modulus.

DESCRIPTION OF THE PREFERRED EMBODIMENTS

A pitch containing 5 to 35 wt. % of mesophase is obtained by heat-treating a carboneous pitch such as a coal pitch or a petroleum pitch to allow mesophase to be formed.

The mesophase formation is carried out usually by heat treatment at a temperature ranging from 340° to 450° C., preferably 370° to 420° C., at atmospheric or reduced pressure. It is also preferable that this heat treatment be conducted while introducing an inert gas such as nitrogen gas. The duration of the heat treatment may vary according to conditions such as the treating temperature and the amount of inert gas introduced, but usually ranges from 1 minute to 30 hours, preferably 5 minutes to 20 hours. The amount of inert gas introduced is preferably in the range of 0.7 to 5.0 scfh/lb pitch.

The mesophase formation is carried out while adjusting to give a mesophase content of the pitch in the range of 5 to 35 wt. %. Outside this range, it is impossible to expect the effect of the present invention.

The pitch containing 5 to 35 wt. % of mesophase is then contacted with sulfur. Usually, this treatment is conducted by adding sulfur into the pitch and heating the pitch composition at a temperature ranging from 150° to 400° C., preferably 200° to 350° C., at an atmospheric pressure or under application of pressure. The duration of this treatment may vary according to conditions such as the treating temperature and the amount of sulfur added, but usually ranges from 5 minutes to 3 hours, preferably 10 minutes to 2 hours. The amount of sulfur added is in the range of 0.5 to 10 wt. %, preferably 1 to 5 wt. %.

The pitch thus treated is then subjected to melt spinning by a conventional method.

The resultant pitch fiber is then rendered infusible in an oxidizing gas atmosphere. As the oxidizing gas, there may be used one or more of oxidizing gases such as oxygen, ozone, air, nitrogen oxide, halogen and sulfurous acid gas. This treatment for rendering the pitch fiber infusible is carried out under a temperature condition under which the melt-spun pitch fiber being treated does not soften and change in shape, for example, at a temperature in the range of 20° to 360° C., preferably 20° to 300° C. The duration of this treatment usually ranges from 5 minutes to 10 hours.

The pitch fiber thus rendered infusible is then subjected to carbonization and subsequent graphitization if required, in an inert gas atmosphere, to obtain carbon fiber. The carbonization treatment is carried out at a temperature usually ranging from 800° to 2,500° C. Generally, the time required for carbonization is 0.5 minute to 10 hours. Subsequently, graphitization may be performed, if required, at a temperature in the range of 2,500° to 3,500° C. for usually 1 second to 1 hour.

During the treatment for rendering the pitch fiber infusible or for carbonizing or graphitizing it, the pitch fiber being treated may be held under a slight load or tension.

The following examples and comparative examples. are given to further illustrate the present invention, but it is to be understood that the invention is not limited thereto.

EXAMPLE 1

A heavy oil (properties of which are shown in Table 1) with a boiling point not lower than 200° C. by-produced in steam cracking of naphtha at 830° C. was heat-treated at 400° C. under a pressure of 15 kg/cm$^2$.G for 3 hours. The heat-treated oil thus obtained was distilled at 250° C./1 mmHg to distill off the light fraction therefrom to obtain a starting pitch (1) having a softening point of 82° C. 30 g. of the starting pitch (1) was heat-treated at 400° C. for 1 hour with stirring while nitrogen was introduced therein at a rate of 600 ml/min, to obtain a pitch (2) having a melting point of 220° C. and a mesophase content of 20 wt. %.

Then, 30 g. of the pitch (2) was stirred with 3 wt. % of sulfur for 90 minutes at 300° C. to obtain a pitch (3) having a softening point of 255° C. and a mesophase content of 20 wt. %.

The pitch (3) thus prepared was melt-spun at 325° C. by means of a spinning apparatus having a nozzle diameter of 0.3 mm and an L/D ratio of 2.0 to obtain pitch fiber of 16–19$\mu$. The pitch fiber thus obtained was then rendered infusible, carbonized and graphitized under the following conditions to obtain carbon fiber.

Infusiblization Condition: Heat in an air atmosphere at a rate of 3° C./min up to 200° C. and 1° C./min up to 300° C., and hold at 300° C. for 30 minutes.

Carbonization Condition: Heat in a nitrogen atmosphere at a rate of 5° C./min and hold at 1,000° C. for 30 minutes.

Graphitization Condition: Heat in an argon gas stream up to 2,500° C. at a rate of 25° C./min.

The carbon fiber thus obtained proved to have a tensile strength of 250 kg/mm$^2$ and a Young's modulus of 22 ton/mm$^2$.

TABLE 1

| Heavy oil properties | | |
|---|---|---|
| Specific Gravity (15° C./4° C.) | | 1.039 |
| Distillation property | Initial boiling point | 192° C. |
| | 5% | 200 |
| | 10% | 206 |
| | 20% | 217 |
| | 30% | 227 |
| | 40% | 241 |
| | 50% | 263 |
| | 60% | 290 |
| | 70% | 360 |

COMPARATIVE EXAMPLE 1

The pitch (2) used in Example 1 was subjected, directly without going through the treatment with sulfur, to melt spinning in the same way as in Example 1. As a result, there occurred breakage of thread frequently and it was impossible to effect spinning continuously.

EXAMPLE 2

The starting pitch (1) used in Example 1 was heat-treated at 400° C. for 2 hours with stirring while nitrogen was introduced therein in the same way as in Example 1, to obtain a pitch (4) having a softening point of 230° C. and a mesophase content of 33 wt. %.

Then, the pitch (4) thus obtained was stirred with 1 wt. % of sulfur for 90 minutes at 30° C. to obtain a pitch (5) having a softening point of 270° C. and a mesophase content of 33 wt. %.

The pitch (5) thus obtained was melt-spun at 340° C. by means of the spinning apparatus used in Example 1 and then subjected to infusiblization, carbonization and graphitization treatments in the same way as in Example 1, to obtain carbon fiber.

The carbon fiber thus obtained proved to have a tensile strength of 270 kg/mm$^2$ and a Young's modulus of 30 ton/mm$^2$.

EXAMPLE 3

The starting pitch (1) used in Example 1 was heat-treated at 400° C. for 30 minutes with stirring while nitrogen was introduced therein in the same way as in Example 1, to obtain a pitch (6) having a softening point of 198° C. and a mesophase content of 8 wt. %.

Then, the pitch (6)thus obtained was stirred with 5 wt. % of sulfur for 90 minutes at 300° C. to obtain a pitch (7) having a softening point of 243° C. and a mesophase content of 8 wt. %.

The pitch (7) thus obtained was melt-spun at 315° C. by means of the spinning apparatus used in Example 1 and then subjected to infusiblization, carbonization and graphitization treatments in the same way as in Example 1 to obtain carbon fiber.

The carbon fiber thus obtained proved to have a tensile strength of 200 kg/mm$^2$ and a Young's modulus of 20 ton/mm$^2$.

EXAMPLE 4

A heavy oil (properties of which are shown in Table 2) obtained by subjecting a vacuum-distilled light oil from Arabic crude oil to catalytic cracking at 500° C. in the presence of a silica-alumina catalyst was heat-treated at 430° C. under a pressure of 15 kg/cm$^2$.G for 3 hours. The heat-treated oil thus obtained was distilled at 250° C./1 mmHg to distill off the light fraction therefrom to obtain a starting pitch (8) having a softening point of 85° C. 30 g. of the starting pitch (8) was heat-treated at 400° C. for 1.5 hours while nitrogen was introduced therein in the same way as in Example 1, to obtain a pitch (9) having a softening point of 225° C. and a mesophase content of 32 wt. %.

Then, the pitch (9) thus obtained was stirred with 3 wt. % of sulfur for 90 minutes at 300° C. to obtain a pitch (10) having a softening point of 260° C. and a mesophase content of 32 wt. %.

The pitch (10) thus obtained was melt-spun at 310° C. by means of the apparatus used in Example 1 and then subjected to infusiblization, carbonization and graphitization treatments in the same way as in Example 1 to obtain carbon fiber.

The carbon fiber thus obtained proved to have a tensile strength of 250 kg/mm$^2$ and a Young's modulus of 35 ton/mm$^2$.

TABLE 2

| Heavy oil properties | | |
|---|---|---|
| Specific Gravity (15° C./4° C.) | | 0.965 |
| Distillation property | Initial boiling point | 320° C. |
| | 5% | 340 |
| | 10% | 353 |
| | 20% | 370 |
| | 30% | 385 |
| | 40% | 399 |
| | 50% | 415 |
| | 60% | 427 |
| | 70% | 445 |
| | 80% | 467 |
| | 90% | 512 |
| Viscosity cSt @ 50° C. | | 18.21 |

COMPARATIVE EXAMPLE 2

The pitch (9) used in Example 4 was subjected, directly without going through the treatment with sulfur, to melt spinning in the same way as in Example 1. As a result, there occurred breakage of thread frequently and it was impossible to effect spinning continuously.

What is claimed is:

1. A process for preparing a pitch for carbon fibers comprising, heat treating a carbonaceous pitch to form a content of 5 to 35 weight percent of an optically anisotropic region and adding into said pitch 0.5 to 10 weight percent of sulfur at a temperature of 150° to 400° C.

2. The process of claim 1 wherein said carbonaceous pitch is heat treated at a temperature of 340° to 450° C. at atmospheric or reduced pressure to form said content of 5 to 35 weight percent of the optically anisotropic region.

3. The process of claim 1 wherein said heat treating is conducted while introducing an inert gas to form said content of 5 to 35 weight percent of the optically anisotropic region.

4. The process of claim 3 wherein the amount of inert gas introduced ranges from 0.7 to 5.0 scfh/lb. pitch.

5. The process of claim 3 wherein said inert gas is nitrogen.

* * * * *